US011054775B2

(12) United States Patent
Matsuda et al.

(10) Patent No.: US 11,054,775 B2
(45) Date of Patent: Jul. 6, 2021

(54) FIXING DEVICE AND IMAGE FORMING APPARATUS INCORPORATING SAME

(71) Applicants: Ryohei Matsuda, Kanagawa (JP); Yoshiharu Takahashi, Tokyo (JP); Hitoshi Fujiwara, Kanagawa (JP); Naoki Iwaya, Tokyo (JP)

(72) Inventors: Ryohei Matsuda, Kanagawa (JP); Yoshiharu Takahashi, Tokyo (JP); Hitoshi Fujiwara, Kanagawa (JP); Naoki Iwaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/874,089

(22) Filed: May 14, 2020

(65) Prior Publication Data

US 2020/0401068 A1 Dec. 24, 2020

(30) Foreign Application Priority Data

Jun. 19, 2019 (JP) ..... JP2019-113679
Jul. 25, 2019 (JP) ..... JP2019-136811

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01); *G03G 15/2064* (2013.01); *G03G 2215/2038* (2013.01)

(58) Field of Classification Search
CPC ..... G03G 15/0105; G03G 15/2017; G03G 15/2039; G03G 15/2053; G03G 15/2064;
(Continued)

(56) References Cited

U.S. PATENT DOCUMENTS 9,116,494 B2 * 8/2015 Tokuda ..... G03G 15/2053
10,025,247 B2 * 7/2018 Sawada ..... G03G 15/206
(Continued)

FOREIGN PATENT DOCUMENTS

JP 2011-008062 1/2011
JP 2011-028138 2/2011
(Continued)

OTHER PUBLICATIONS

U.S. Appl. No. 16/750,066, filed Jan. 23, 2020, Hitoshi Fujiwara.
(Continued)

*Primary Examiner* — Hoan H Tran
(74) *Attorney, Agent, or Firm* — Oblon, McClelland, Maier & Neustadt, L.L.P.

(57) ABSTRACT

A fixing device includes a belt, an opposed rotator, a nip formation pad, a heater, a stay, and a positioner. The nip formation pad has a plurality of projections in a longitudinal direction of the nip formation pad. The positioner is disposed between the nip formation pad and the stay to position the nip formation pad. The positioner has a plurality of insertion holes arranged in a longitudinal direction of the positioner to accept the projections and restrict movement of the nip formation pad with respect to the positioner in a rotation direction of the belt and a direction opposite the rotation direction. The plurality of insertion holes includes an insertion hole disposed at a position corresponding to an end portion of the nip formation pad to accept two or more projections of the projections arranged in the longitudinal direction of the nip formation pad.

8 Claims, 10 Drawing Sheets

(58) Field of Classification Search
CPC ... G03G 2215/2003; G03G 2215/2022; G03G 2215/2035
USPC ..... 399/107, 110, 122, 320, 328, 329
See application file for complete search history.

(56) References Cited

U.S. PATENT DOCUMENTS

| | | | | |
|---|---|---|---|---|
| 10,317,823 | B2 * | 6/2019 | Fujimoto | G03G 15/2028 |
| 10,503,104 | B2 * | 12/2019 | Matsuura | G03G 15/6594 |
| 10,635,035 | B2 * | 4/2020 | Yabuki | G03G 15/2028 |
| 2011/0026987 | A1 | 2/2011 | Hasegawa | |
| 2014/0064804 | A1 | 3/2014 | Yamaguchi et al. | |
| 2015/0125193 | A1 | 5/2015 | Ishii et al. | |
| 2018/0284669 | A1 | 10/2018 | Fujimoto et al. | |

FOREIGN PATENT DOCUMENTS

| | | |
|---|---|---|
| JP | 2014-048487 | 3/2014 |
| JP | 2014-174370 | 9/2014 |
| JP | 2015-111243 | 6/2015 |

OTHER PUBLICATIONS

U.S. Appl. No. 16/794,976, filed Feb. 19, 2020, Ryohei Matsuda, et al.
U.S. Appl. No. 16/811,955, filed Mar. 6, 2020, Yoshiharu Takahashi, et al.

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119 to Japanese Patent Applications No. 2019-113679, filed on Jun. 19, 2019 and No. 2019-136811, filed on Jul. 25, 2019 in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device.

Background Art

One type of fixing device includes an endless belt formed into the shape of a hollow cylinder or loop, an opposed member opposite the belt, a nip formation pad to contact the inner surface of the belt from within the loop formed by the belt and form a fixing nip between the belt and the opposed member, and a support such as a stay to contact a back surface of the nip formation pad and support the nip formation pad.

The above-described nip formation pad needs to be arranged at a predetermined position in the fixing device to form a fixing nip of suitable range between the opposed member and the belt.

SUMMARY

This specification describes an improved fixing device that includes an endless belt, an opposed rotator opposite the belt, a nip formation pad disposed inside a loop of the belt and configured to contact the opposed rotator via the belt to form a fixing nip between the opposed rotator and the nip formation pad, a heater configured to heat the belt disposed inside the loop of the belt, a stay disposed inside the loop of the belt to support the nip formation pad, and a positioner. The nip formation pad has a plurality of projections in a longitudinal direction of the nip formation pad. The positioner is configured to position the nip formation pad in the fixing device and disposed between the nip formation pad and the stay. The positioner has a plurality of insertion holes arranged in a longitudinal direction of the positioner. The positioner is configured to accept the plurality of projections and restrict movement of the nip formation pad with respect to the positioner in a rotation direction of the belt and a direction opposite the rotation direction of the belt. The plurality of insertion holes includes an insertion hole disposed at a position corresponding to an end portion of the nip formation pad and configured to accept two or more projections of the plurality of projections arranged in the longitudinal direction of the nip formation pad.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
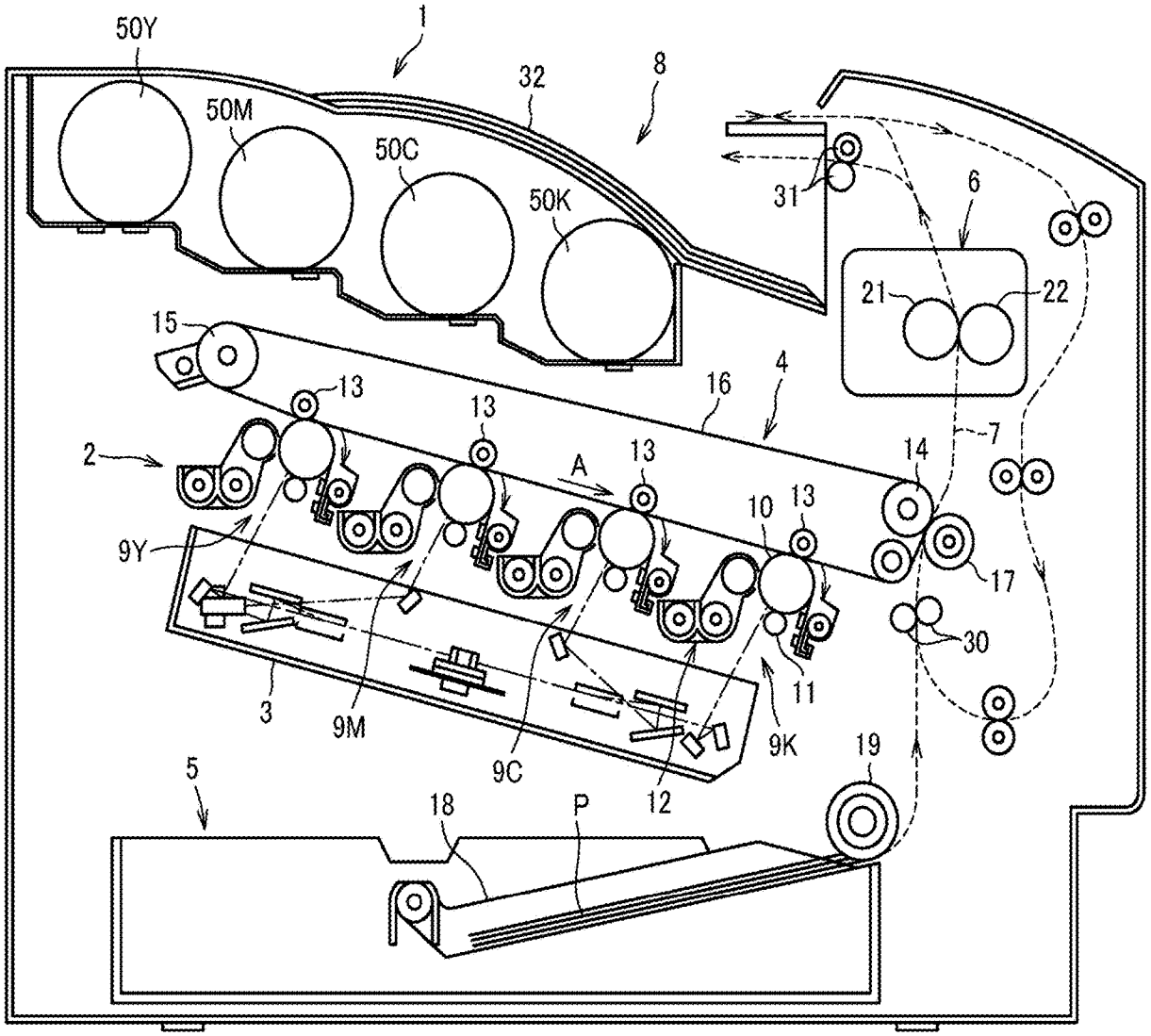
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring to the drawings, embodiments of the present disclosure are described below. Identical reference numerals are assigned to identical components or equivalents and a description of those components is simplified or omitted.

As illustrated in FIG. 1, the image forming apparatus 1 includes an image forming device 2 disposed in a center portion of the image forming apparatus 1. The image forming device 2 includes four process units 9Y, 9M, 9C, and 9K removably installed in the image forming apparatus 1. The process units 9Y, 9M, 9C, and 9K have identical configurations, except that the process units 9Y, 9M, 9C, and 9K contain developers in different colors, that is, yellow (Y), magenta (M), cyan (C), and black (K) corresponding to color-separation components of a color image.

Specifically, each of the process units 9Y, 9M, 9C, and 9K includes, e.g., a photoconductor 10, a charging roller 11, and a developing device 12. The photoconductor 10 is a drum-shaped rotator serving as an image bearer that bears toner as a developer on a surface of the photoconductor 10. The charging roller 11 uniformly charges the surface of the photoconductor 10. The developing device 12 includes a developing roller to supply toner to the surface of the photoconductor 10.

Below the process units 9Y, 9C, 9M, and 9K, an exposure device 3 is disposed. The exposure device 3 emits laser light beams based on image data.

Above the image forming device 2, a transfer device 4 is disposed. The transfer device 4 includes, e.g., a drive roller 14, a driven roller 15, an intermediate transfer belt 16, and four primary transfer rollers 13. The intermediate transfer belt 16 is an endless belt rotatably stretched around the drive roller 14, the driven roller 15, and the like. Each of the four primary transfer rollers 13 is disposed opposite the corresponding photoconductor 10 in each of the process units 9Y, 9C, 9M, and 9K via the intermediate transfer belt 16. At the position opposite the photoconductor 10, each of the four primary transfer rollers 13 presses an inner circumferential surface of the intermediate transfer belt 16 against the corresponding photoconductor 10 to form a primary transfer nip between a pressed portion of the intermediate transfer belt 16 and the photoconductor 10.

A secondary transfer roller 17 is disposed opposite the drive roller 14 via the intermediate transfer belt 16. The secondary transfer roller 17 is pressed against an outer circumferential surface of the intermediate transfer belt 16 to form a secondary transfer nip between the secondary transfer roller 17 and the intermediate transfer belt 16. The drive roller 14, the intermediate transfer belt 16, and the secondary transfer roller 17 function as an image transferor to transfer an image onto a sheet P as a recording medium.

A sheet feeder 5 is disposed in a lower portion of the image forming apparatus 1. The sheet feeder 5 includes a sheet tray 18, which contains sheets P as recording media, and a sheet feeding roller 19 to feed the sheets P from the sheet tray 18.

The sheets P are conveyed along a conveyance path 7 from the sheet feeder 5 toward a sheet ejector 8. Conveyance roller pairs including a registration roller pair 30 are disposed along the conveyance path 7.

The fixing device 6 includes a fixing belt 21 as a fixing rotator and a belt, which is heated by a heater and a pressure roller 22 as an opposed member that presses against the fixing belt 21.

The sheet ejector 8 is disposed in an extreme downstream part of the conveyance path 7 in a direction of conveyance of the sheet P (hereinafter referred to as a sheet conveyance direction) in the image forming apparatus 1. The sheet ejector 8 includes an ejection roller pair 31 and an output tray 32. The ejection roller pair 31 ejects the sheets P onto the output tray 32 disposed atop a housing of the image forming apparatus 1. Thus, the sheets P lie stacked on the output tray 32.

In an upper portion of the image forming apparatus 1, removable toner bottles 50Y, 50C, 50M, and 50K are disposed. The toner bottles 50Y, 50C, 50M, and 50K are filled with fresh toner of yellow, cyan, magenta, and black, respectively. A toner supply tube is interposed between each of the toner bottles 50Y, 50C, 50M, and 50K and the corresponding developing devices 12. The fresh toner is supplied from each of the toner bottles 50Y, 50C, 50M, and 50K to the corresponding developing device 12 through the toner supply tube.

Next, a description is given of a basic operation of the image forming apparatus 1 with reference to FIG. 1.

As the image forming apparatus 1 receives a print job and starts an image forming operation, the exposure device 3 emits laser light beams onto the outer circumferential surfaces of the photoconductors 10 of the process units 9Y, 9M, 9C, and 9K according to image data, thus forming electrostatic latent images on the photoconductors 10. The image data used to expose the respective photoconductors 10 by the exposure device 3 is monochrome image data produced by decomposing a desired full color image into yellow, magenta, cyan, and black image data. After the exposure device 3 forms the electrostatic latent images on the photoconductors 10, the drum-shaped developing rollers of the developing devices 12 supply yellow, magenta, cyan, and black toners stored in the developing devices 12 to the electrostatic latent images, rendering visible the electrostatic latent images as developed visible images, that is, yellow, magenta, cyan, and black toner images, respectively.

In the transfer device 4, the intermediate transfer belt 16 moves along with rotation of the drive roller 14 in a direction indicated by arrow Ain FIG. 1. A power supply applies a constant voltage or a constant current control voltage having a polarity opposite a polarity of the toner to each primary transfer roller 13. As a result, a transfer electric field is formed at the primary transfer nip. The yellow, magenta, cyan, and black toner images are primarily transferred from the photoconductors 10 onto the intermediate transfer belt 16 successively at the primary transfer nips such that the yellow, magenta, cyan, and black toner images are superimposed on a same position on the intermediate transfer belt 16.

On the other hand, as the image forming operation starts, the sheet feeding roller 19 of the sheet feeder 5 disposed in the lower portion of the image forming apparatus 1 is driven and rotated to feed the sheet P from the sheet tray 18 toward the registration roller pair 30 through the conveyance path 7. The registration roller pair 30 conveys the sheet P fed to the conveyance path 7 by the sheet feeding roller 19 to the secondary transfer nip formed between the secondary transfer roller 17 and the intermediate transfer belt 16 supported by the drive roller 14, timed to coincide with the superimposed toner image on the intermediate transfer belt 16. At this time, a transfer voltage having a polarity opposite the toner charge polarity of the toner image formed on the surface of the intermediate transfer belt 16 is applied to the sheet P, and the transfer electric field is generated in the secondary transfer nip. Due to the transfer electric field generated in the secondary transfer nip, the toner images formed on the intermediate transfer belt 16 are collectively transferred onto the sheet P.

The sheet P bearing the full color toner image is conveyed to the fixing device 6 in which the fixing belt 21 and the pressure roller 22 fix the full color toner image onto the sheet P under heat and pressure. The sheet P having the fixed toner image thereon is separated from the fixing belt 21 and conveyed by the conveyance roller pair to the sheet ejector 8. The ejection roller pair 31 of the sheet ejector 8 ejects the sheet P onto the output tray 32.

The above description is of the image forming operation of the image forming apparatus 1 to form the full color toner image on the sheet P. Alternatively, the image forming apparatus 1 may form a monochrome toner image by using any one of the four process units 9Y, 9M, 9C, and 9K, or may form a bicolor toner image or a tricolor toner image by using two or three of the process units 9Y, 9M, 9C, and 9K.

Figure 2:
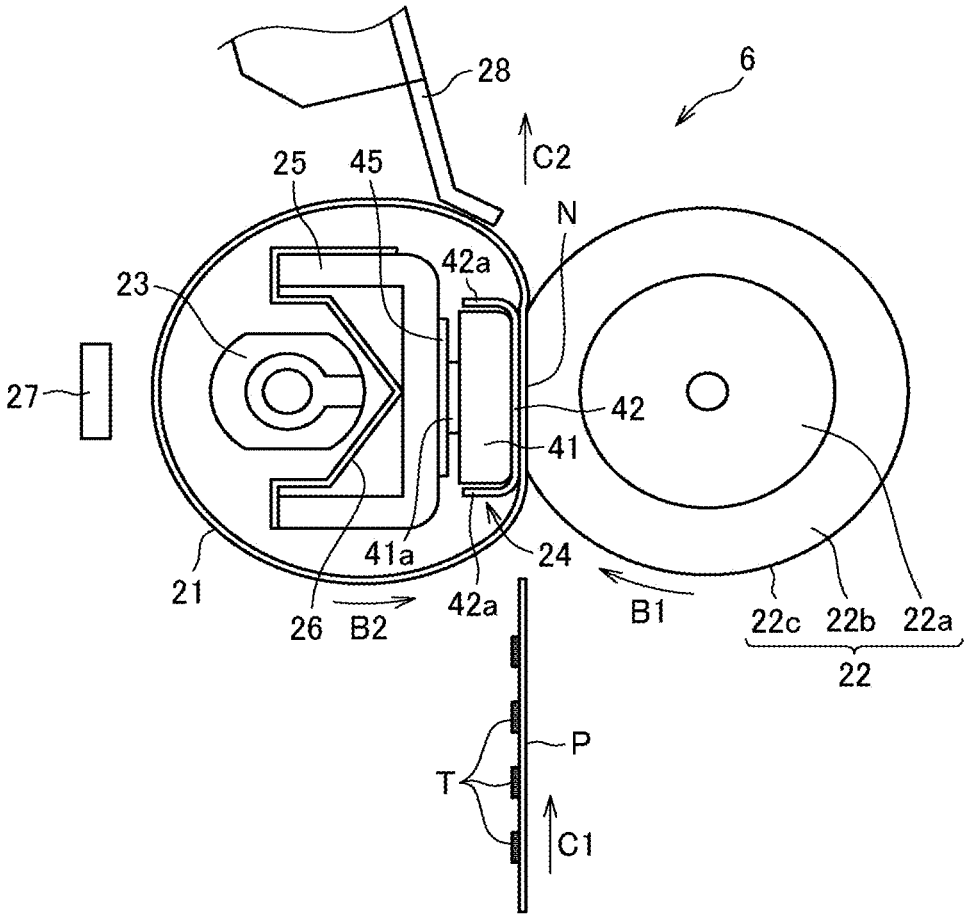
FIG. 2 is an explanatory diagram illustrating a configuration of a fixing device according to the embodiment of the present disclosure.

With reference to FIG. 2, a detailed description is provided of a basic configuration of the fixing device 6.

As illustrated in FIG. 2, the fixing device 6 includes an endless rotatable fixing belt 21, a pressure roller 22 rotatably disposed opposite the fixing belt 21, a halogen heater 23 as a heater to heat the fixing belt 21, a nip formation pad 24 disposed inside a loop of the fixing belt 21, a stay 25 as a support to contact a back face of the nip formation pad 24 and support the nip formation pad 24, a reflector 26 to reflect light radiated from the halogen heater 23 toward the fixing belt 21, a temperature sensor 27 as a temperature detector to detect the temperature of the fixing belt 21, a separator 28 to separate the sheet from the fixing belt 21, and a biasing mechanism that presses the pressure roller 22 against the fixing belt 21.

The fixing belt 21 is a thin, flexible, endless belt member (which may be a film). The fixing belt 21 is constructed of a base layer to form the inner circumferential surface of the fixing belt 21 and a release layer to form the outer circumferential surface of the fixing belt 21. The base layer is made of metal such as nickel or stainless steel (Stainless Used Steel, SUS). Alternatively, the base layer may be made of resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, or fluoro rubber may be interposed between the base layer and the release layer.

The pressure roller 22 includes a cored bar 22*a*; an elastic layer 22*b* disposed on the surface of the cored bar 22*a*, which is made of or includes foamed silicone rubber, silicon rubber, or the fluoro-rubber; and a release layer 22*c* disposed on the elastic layer 22*b*, which is made of or includes PFA or PTFE. A biasing mechanism presses the pressure roller 22 against the nip formation pad 24 via the fixing belt 21. At a portion at which the pressure roller 22 contacts and presses the fixing belt 21, deformation of the elastic layer 22*b* of the pressure roller 22 forms the fixing nip N having a predetermined width in the recording medium conveyance direction. A driver such as a motor disposed inside the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22.

According to the present embodiment, the pressure roller 22 is a solid roller. Alternatively, the pressure roller 22 may be a hollow roller. In a case in which the pressure roller 22 is a hollow roller, a heat source such as a halogen heater may be disposed inside the pressure roller 22. If the pressure roller 22 does not include the elastic layer 22*b*, the pressure roller 22 has a decreased thermal capacity and can be heated quickly to a predetermined fixing temperature at which a toner image T is fixed on a sheet P properly. However, as the pressure roller 22 and the fixing belt 21 sandwich and press the unfixed toner image T on the sheet P passing through the fixing nip N, slight surface asperities of the fixing belt 21 may be transferred onto the toner image T on the sheet P, resulting in variation in gloss of the solid toner image T.

To address this circumstance, preferably, the fixing belt 21 includes the elastic layer not thinner than 100 μm. The elastic layer not thinner than 100 μm elastically deforms to absorb the slight surface asperities in the fixing belt 21, thus preventing uneven gloss of the toner image on the sheet P. The elastic layer 22*b* may be made of solid rubber. Alternatively, if no heater is situated inside the pressure roller 22, the elastic layer 22*b* may be made of sponge rubber. The sponge rubber is preferable to the solid rubber because the sponge rubber has enhanced thermal insulation and so draws less heat from the fixing belt 21. According to this embodiment, the pressure roller 22 is pressed against the fixing belt 21. Alternatively, the fixing rotator may merely contact the opposed member with no pressure therebetween.

Both ends of the halogen heater 23 are fixed to side plates of the fixing device 6. A power supply situated inside the image forming apparatus 1 supplies power to the halogen heater 23 so that the halogen heater 23 generates heat. A controller operatively connected to the halogen heater 23 and the temperature sensor 27 controls the halogen heater 23 based on the temperature of the outer circumferential surface of the fixing belt 21, which is detected by the temperature sensor 27. Such heating control of the halogen heater 23 adjusts the temperature of the fixing belt 21 to a desired fixing temperature. As a heater to heat the fixing belt 21, an induction heater (IH), a resistive heat generator, a carbon heater, or the like may be employed instead of the halogen heater 23.

The nip formation pad 24 extends in a width direction of the fixing belt 21 or an axial direction of the pressure roller 22 which is a direction perpendicular to a sheet surface of FIG. 2 and hereinafter referred to as a longitudinal direction of the nip formation pad 24 or the stay 25. The stay 25 supports the nip formation pad 24. Accordingly, even if the nip formation pad 24 is pressed by the pressure roller 22, the stay 25 prevents the nip formation pad 24 from being bent by the pressure of the pressure roller 22 and therefore allows the nip formation pad 24 to maintain a uniform nip length of the fixing nip N over the entire width of the pressure roller 22 in an axial direction of the pressure roller 22. A detailed description of a configuration of the nip formation pad 24 is deferred.

The stay 25 extends in the longitudinal direction of the nip formation pad 24. The stay 25 contacts the back side of the nip formation pad 24 over the longitudinal direction of the nip formation pad 24 to support the nip formation pad 24 against the pressure from the pressure roller 22. Preferably, the stay 25 is made of metal having an increased mechanical strength, such as stainless steel and iron, to prevent bending of the nip formation pad 24. Alternatively, the stay 25 may be made of resin.

When the stay 25 supports the nip formation pad 24, a surface of the nip formation pad 24 opposite the pressure roller 22 that is a left surface of the nip formation pad in FIG. 2 contacts the stay 25 having a portion extending in the pressing direction of the pressure roller 22 (the lateral direction in FIG. 2) or a certain thick portion. Such a configuration reduces a bend of the nip formation pad 24 caused by the pressing force from the pressure roller 22, in particular, the bend in the longitudinal direction of the nip formation pad 24 in the present embodiment. However, the above-described contact includes not only the case in which the stay 25 is in direct contact with the nip formation pad 24 but also the case in which the stay 25 contacts the nip formation pad 24 via another member. The term "contact via another member" means a state in which another member is interposed between the stay 25 and the nip formation pad 24 in the lateral direction in FIG. 2 and at a position corresponding to at least a part of the member, the stay 25 contacts the member and the member contacts the nip formation pad 24. The term "extending in the pressing direction" is not limited to a case in which the portion of the stay 25 extends in the same direction as the pressing direction of the pressure roller 22, but includes the case in which the portion of the stay 25 extends in a direction with a certain angle from the pressing direction of the pressure roller 22. Even in such cases, the stay 25 can reduce bending of the nip formation pad 24 under pressure from the pressure roller 22.

The reflector 26 is interposed between the stay 25 and the halogen heater 23. In the present embodiment, the reflector 26 is secured to the stay 25. The reflector 26 is made of aluminum, stainless steel, or the like. The reflector 26 thus disposed reflects, to the fixing belt 21, the light radiated from the halogen heater 23 toward the stay 25. Such reflection by the reflector 26 increases an amount of light that irradiates the fixing belt 21, thereby heating the fixing belt 21 efficiently. In addition, the reflector 26 prevents transmitting radiant heat from the halogen heater 23 to the stay 25 and the like, thus saving energy.

Alternatively, instead of installation of the reflector 26, an opposed face of the stay 25 disposed opposite the halogen heater 23 may be treated with polishing or mirror finishing such as coating to produce a reflection face that reflects light from the halogen heater 23 toward the fixing belt 21. Preferably, the reflector 26 or the reflection surface of the stay 25 has a reflectance of 90% or more.

Since the shape and the material of the stay 25 are limited to those that provide good mechanical strength, if the reflector 26 is installed in the fixing device 6 separately from the stay 25, the reflector 26 and the stay 25 provide flexibility in the shape and the material, attaining properties peculiar to them, respectively. The reflector 26 interposed between the halogen heater 23 and the stay 25 is situated in proximity to the halogen heater 23, reflecting light from the halogen heater 23 toward the fixing belt 21 to heat the fixing belt 21 effectively.

In order to further enhance the efficiency of heating the fixing belt 21 by light reflection, the direction of the reflector 26 or the reflection surface of the stay 25 is to be considered. For example, when the reflector 26 is disposed concentrically with the halogen heater 23 as the center, the reflector 26 reflects light toward the halogen heater 23, resulting in a decrease in heating efficiency. By contrast, when a part or all of the reflector 26 is disposed in a direction to reflect light toward the fixing belt 21, not a direction to reflect light toward the halogen heater 23, the reflector 26 reflects less light toward the halogen heater 23, thereby enhancing the efficiency of heating the fixing belt 21 by the reflected light.

A description is now given of various structural advantages of the fixing device 6 to enhance energy saving and shorten a first print time taken to output the sheet P bearing the fixed toner image upon receipt of a print job through preparation for a print operation and the subsequent print operation. For example, the fixing device 6 may employ a direct heating method in which the halogen heater 23 directly heats the fixing belt 21 in a circumferential direct heating span on the fixing belt 21 other than the fixing nip N. According to the present embodiment, no component is interposed between a left side of the halogen heater 23 and the fixing belt 21 in FIG. 2 such that the halogen heater 23 radiates heat directly to the circumferential direct heating span on the fixing belt 21.

In order to decrease the thermal capacity of the fixing belt 21, the fixing belt 21 is thin and has a decreased loop diameter. For example, the base layer of the fixing belt 21 is designed to have a thickness of from 20 μm to 50 μm, the elastic layer is designed to have a thickness of from 100 μm to 300 μm, and the release layer is designed to have a thickness of from 10 μm to 50 μm. Thus, the fixing belt 21 is designed to have a total thickness not greater than 1 mm. The loop diameter of the fixing belt 21 is set in a range of from 20 mm to 40 mm. In order to further decrease the thermal capacity of the fixing belt 21, preferably, the fixing belt 21 may have the total thickness not greater than 0.20 mm and more preferably not greater than 0.16 mm. Preferably, the loop diameter of the fixing belt 21 may not be greater than 30 mm.

According to the present embodiment, the pressure roller 22 has a diameter in a range of from 20 mm to 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P from the fixing belt 21 as it is ejected from the fixing nip N.

With continued reference to FIG. 2, a description is now given of a fixing operation of the fixing device 6 according to the present embodiment.

As the image forming apparatus 1 illustrated in FIG. 1 is powered on, the halogen heater 23 is supplied with power, and the driver starts driving and rotating the pressure roller 22 in a clockwise direction of rotation indicated by arrow B1 as illustrated in FIG. 2. The rotation of the pressure roller 22 drives the fixing belt 21 to rotate in a counterclockwise direction of rotation indicated by arrow B2 as illustrated in FIG. 2 by friction between the fixing belt 21 and the pressure roller 22.

Thereafter, the sheet P bearing the unfixed toner image T formed in the image forming processes described above is conveyed in the sheet conveyance direction C1 in FIG. 2 while guided by a guide plate and enters the fixing nip N formed between the fixing belt 21 and the pressure roller 22 pressed against the fixing belt 21. The toner image T is fixed onto the sheet P under heat from the fixing belt 21 heated by the halogen heater 23 and pressure exerted between the fixing belt 21 and the pressure roller 22.

The sheet P bearing the fixed toner image T is sent out from the fixing nip N and conveyed in a direction C2 as illustrated in FIG. 2. As a leading edge of the sheet P contacts a front edge of the separator 28, the separator 28 separates the sheet P from the fixing belt 21. The sheet P separated from the fixing belt 21 is ejected by the ejection roller pair 31 depicted in FIG. 1 onto the outside of the image forming apparatus 1, that is, the output tray 32 that stacks the sheet P.

Next, the configuration of the nip formation pad 24 is described in detail.

Figure 3:
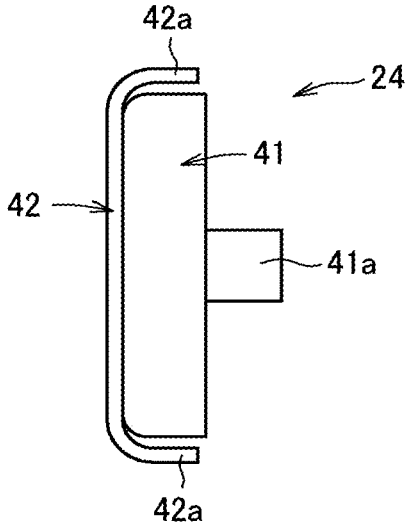
FIG. 3 is a side view of a nip formation pad.

As illustrated in FIG. 3, the nip formation pad 24 includes a base 41 and a thermal equalizer 42 as a high thermal conduction member. The base 41 and the thermal equalizer 42 extend in the longitudinal direction of the nip formation pad 24, that is, a direction perpendicular to a sheet surface of FIG. 3. The base 41 and the thermal equalizer 42 are assembled by an appropriate method, for example, physical fitting with a nail or fixing by another fixing component.

The base 41 is made of a heat-resistant material such as an inorganic substance, rubber, resin, or a combination thereof. Examples of the inorganic substance include ceramic, glass, and aluminum. Examples of the rubber include silicone rubber and fluororubber. An example of the resin is fluororesin such as polytetrafluoroethylene (PTFE), perfluoroalkoxy alkane (PFA), ethylenetetrafluoroethylene (ETFE), and tetrafluoroethylene-hexafluoropropylene copolymer (FEP). Other examples of the resin include polyimide (PI), polyamide imide (PAI), polyphenylene sulfide (PPS), polyether ether ketone (PEEK), liquid crystal polymer (LCP), phenolic resin, nylon and aramid.

In the present embodiment, the base 41 is made of LCP having enhanced heat resistance and moldability. The base 41 has a thermal conductivity of, e.g., 0.54 watts per meter-kelvin (W/(m K)).

The thermal equalizer 42 contacts the inner circumferential surface of the fixing belt 21 as illustrated in FIG. 2. The thermal equalizer 42 is made of a material having a thermal conductivity greater than a thermal conductivity of the base 41. Specifically, in the present embodiment, the thermal equalizer 42 is made of SUS having a thermal conductivity in a range of from 16.7 to 20.9 W/(m K). Alternatively, the thermal equalizer 42 may be made of a material having a relatively high thermal conductivity, such as a copper-based material having a thermal conductivity of, e.g., 381 W/(m K) or an aluminum-based material having a thermal conductivity of, e.g., 236 W/(m K).

Arranging the thermal equalizer 42 having a good thermal conductivity on a fixing belt side of the nip formation pad 24 to contact the fixing belt 21 along the width direction of the fixing belt 21 can transmit and equalize heating of the fixing belt 21 in the width direction and thus reduce temperature unevenness of the fixing belt 21 in the width direction.

The thermal equalizer 42 has bent portions 42*a* bent from both ends in a short-side direction of the thermal equalizer 42. The bent portions 42*a* extend in a longitudinal direction of the thermal equalizer 42. In the present embodiment, to form the bent portions 42*a* of the thermal equalizer 42, both end portions of a metal plate in the short-side direction that are an upper side and a lower side in FIG. 3 are bent toward a direction substantially perpendicular to the short-side direction, that is, the right side in FIG. 3 and an opposite direction from the fixing nip N.

Figure 4:
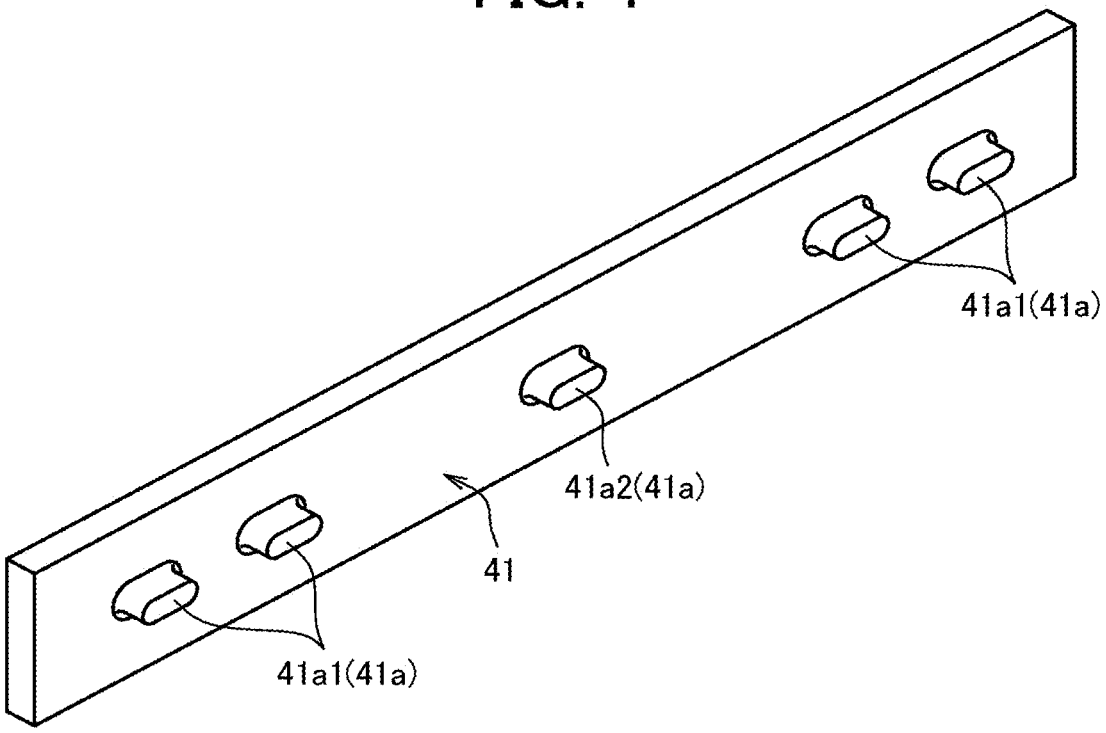
FIG. 4 is a perspective view of a base.

The base 41 has a plurality of projections 41*a* projecting toward the stay 25. The plurality of projections 41*a* positions the nip formation pad 24 to the stay 25. As illustrated in FIG. 4, the plurality of projections 41*a* is arranged in the longitudinal direction of the base 41 and includes projections 41*a*1 disposed at end portions in the longitudinal direction and a projection 41*a*2 disposed at a center portion in the longitudinal direction. The base 41 has a bilaterally symmetrical shape. Note that the center portion in the longitudinal direction corresponds to a center area of three longitudinal areas into which the nip formation pad 24 is divided. The position exactly at the center of the base 41 in the longitudinal direction corresponds to the position of the projection 41*a*2. In addition, the end portions in the longitudinal direction are both end areas next to the center area. Hereinafter, the longitudinal direction of the nip formation pad 24 is also simply referred to as the longitudinal direction.

Each projection 41*a* has curved surfaces on both sides in the longitudinal direction and does not have corners. However, in the following drawings, the projections 41*a* are simply illustrated in rectangular parallelepiped shapes. FIG. 4 illustrates the base 41 having two projections 41*a* provided on each end portion in the longitudinal direction and one projection 41*a* provided on the center portion, but the number and shape of the projections are not limited to this.

Figure 5:
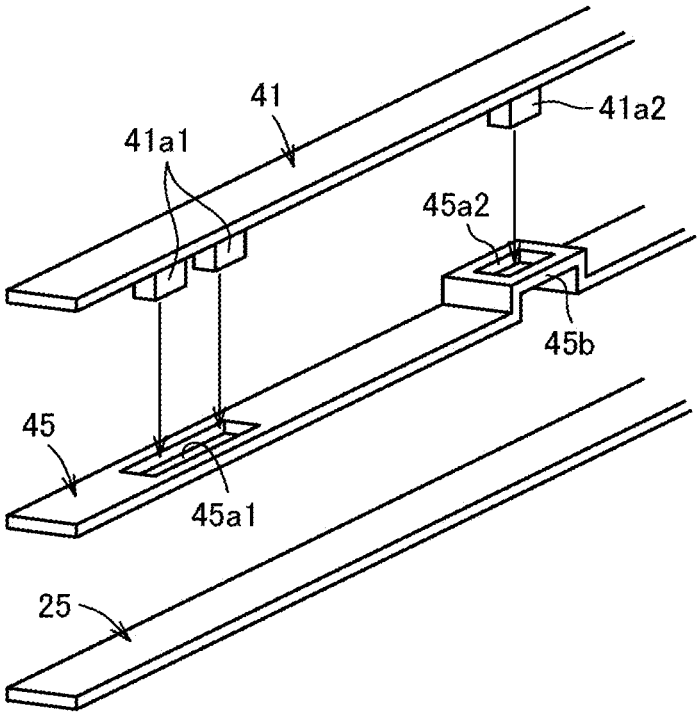
FIG. 5 is a perspective view illustrating how a positioner of a first embodiment of the present disclosure and a stay are coupled to the base.

As illustrated in FIG. 5, a positioner 45 to position the nip formation pad 24 with respect to the stay 25 is disposed between the stay 25 and the base 41. The positioner 45 is placed on the stay 25 with the back surface of the positioner 45 in contact with the stay 25 (see FIG. 2). As a method to fix the positioner 45 on the stay 25, an appropriate method may be adopted. In the present embodiment, the positioner 45 is fixed to the stay 25 by a screw.

As illustrated in FIG. 5, the positioner 45 is a rectangular plate having a bent portion. Specifically, the positioner 45 has a protruding portion 45*b* that is a folded portion protruding toward the base at the center portion of the positioner 45 in the longitudinal direction of the positioner 45. In the present embodiment, the positioner 45 is made of metal.

The positioner 45 has insertion holes 45*a*1 at the end portions in the longitudinal direction and an insertion hole 45*a*2 in the protruding portion 45*b* disposed at the center portion in the longitudinal direction. The insertion holes 45*a*1 and 45*a*2 are holes extending in the longitudinal direction and penetrating in the thickness direction of the positioner 45.

The two projections 41*a*1 of the base 41 are inserted into the insertion holes 45*a*1, and the projection 41*a*2 is inserted into the insertion hole 45*a*2. Thereby, the nip formation pad including the base 41 is positioned on the stay 25 via the positioner 45. Although FIG. 5 illustrates the insertion hole 45*a*1 at one end portion of the positioner 45 in the longitudinal direction, another insertion hole 45*a*1 is at the other end portion of the positioner 45 in the longitudinal direction, which is an upper right side in FIG. 5, and two projections 41*a*1 arranged side by side on the other end portion of the base 41 in the longitudinal direction (see FIG. 4) are inserted. In reality, the base 41 is assembled to the thermal equalizer 42 (see FIG. 2), and projections 41*a*1 and 41*a*2 are inserted into the insertion hole 45*a*1 and 45*a*2, but FIG. 5 omits the thermal equalizer 42.

Inserting the projections 41*a*1 and 41*a*2 into the insertion holes 45*a*1 and 45*a*2 restricts movement of the base 41 to both sides of the base 41 in the short-side direction (the lateral direction in FIG. 5 and the vertical direction in FIG. 2) with respect to the positioner 45. As a result, the projections 41*a*1 and 41*a*2 contact walls of the insertion holes 45*a*1 and 45*a*2 and restrict movement of the nip formation pad 24, which can secure the positional accuracy of the nip formation pad 24 with respect to the positioner 45 and the stay 25, even when, as illustrated in FIG. 2, rotations of the fixing belt 21 in the direction of arrow B2 and the opposite direction apply forces to the nip formation pad 24 in any of the upper and lower directions in FIG. 2.

In the present embodiment, inserting the projections 41*a*1 and 41*a*2 into the insertion holes 45*a*1 and 45*a*2 restricts movement of the base 41 to both sides of the base 41 in the longitudinal direction with respect to the positioner 45. In addition, setting the height of the projection 41*a*2 to be a height in contact with the surface of the stay 25 (see FIG. 7)

can also position the nip formation pad 24 in the thickness direction of the nip formation pad 24.

As described above, without making an insertion hole in the stay 25, the positioner 45, as a component having the insertion hole to insert the projections 41*a*1 and 41*a*2 of the base 41, that is a separate component from the stay 25 can position the nip formation pad 24.

As illustrated in FIG. 2, radiant heat (infrared light) radiated from the halogen heater 23 is reflected by the reflector 26, but a part of the radiant heat is absorbed by the reflector 26. Transmitting a part of the absorbed heat from the reflector 26 to the stay 25 can prevent the temperature of the reflector 26 from becoming excessively high. In the present embodiment, the above-described configuration not having the insertion hole in the stay 25 can increase the volume of the stay 25 and the thermal capacity of the stay 25. Therefore, the above-described configuration can increase the amount of heat that can be transmitted from the reflector 26 to the stay 25 and prevent the reflector 26 from being damaged due to excessively high temperatures.

In addition, the above-described configuration in which inserting the projection on the base 41 into the insertion hole of the positioner 45 can position the nip formation pad on both sides in the longitudinal direction and the short-side direction is a simple configuration to position the nip formation pad as compared with other configurations such as a configuration including positioning ribs provided in many directions and a configuration that holds surfaces of the nip formation pad 24 and the base 41 to restrict their movements. Therefore, the above-described configuration can simplify and downsize the shape of the positioner 45 itself and decrease the thermal capacity of the positioner 45. Therefore, the amount of heat transfer from the nip formation pad 24 to the positioner 45 can be reduced.

In addition, limiting a part of the nip formation pad 24 that contacts the stay 25 and the positioner 45 to position the nip formation pad 24 with respect to the stay 25 and the nip formation pad 24 to the projections 41*a*1 and 41*a*2 of the base 41 can decrease a contact area in which the nip formation pad 24 contacts the stay 25 and the positioner 45, which can reduce heat loss caused by transmission of heat from the nip formation pad 24 to the stay 25 and the positioner 45. Therefore, such a configuration can ensure good heating of the fixing belt.

In addition, the protruding portion 45*b* disposed at the center portion of the positioner 45 in the longitudinal direction of the positioner 45 can separate the positioner 45 from the stay 25 in the center portion. Since the positioner 45 contacts the nip formation pad 24, heat in the fixing nip N is transmitted to the positioner 45 via the nip formation pad 24. Since the protruding portion 45*b* decreases a contact area of the positioner 45 that contacts the stay 25, the above-described configuration can reduce the amount of heat transfer from the positioner 45 to the stay 25 at the center portion of the positioner 45 in the longitudinal direction. Therefore, in the fixing nip N, the above-described configuration can reduce heat loss at the center portion of the fixing belt in the width direction and improve the efficiency of heating the fixing belt. However, the protruding portion 45*b* is not always necessary, and a portion of the positioner in which the insertion hole 45*a*2 is disposed may instead be flat.

In the present embodiment, the insertion hole 45*a*1 at the end portion of the positioner 45 in the longitudinal direction is a slot into which the plurality of projections 41*a*1 can be inserted and is larger than the insertion hole 45*a*2 at the center portion of the positioner 45 in the longitudinal direction. The above-described configuration can set the thermal capacity of the end portion of the positioner 45 in the longitudinal direction smaller than the thermal capacity of the center portion of the positioner 45, which can reduce the amount of heat transfer from the nip formation pad 24 to the positioner 45 at the end portion of the positioner 45 in the longitudinal direction. As a result, the above-described configuration can decrease heat loss at the end portion in the longitudinal direction. In particular, a configuration like the present embodiment using the halogen heater 23 as the heater causes a temperature fall at the end portion of the heater in the longitudinal direction, but the above-described configuration can improve heating at the end portion of the fixing belt in the longitudinal direction and eliminate temperature unevenness in a sheet conveyance span of the fixing belt in the width direction of the fixing belt.

Next, a description is given of a second embodiment.

Figure 6:
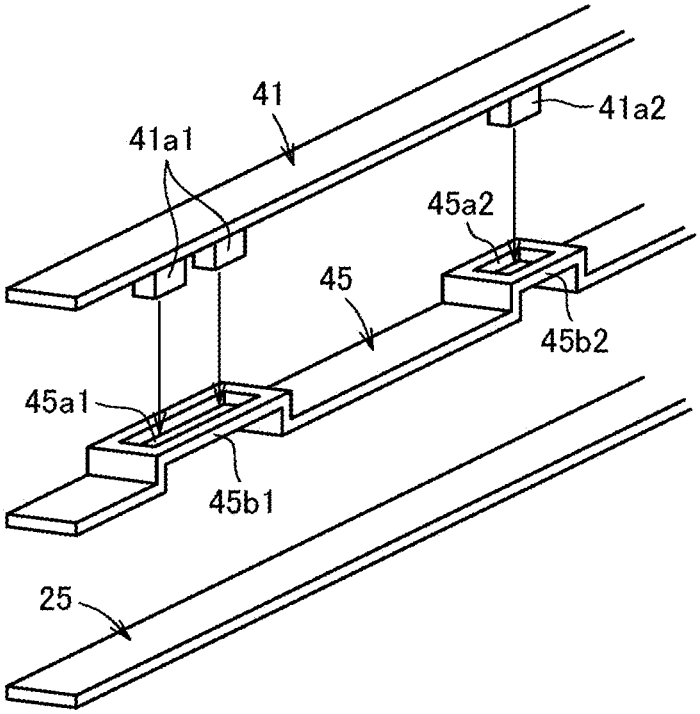
FIG. 6 is a perspective view illustrating how a positioner of a second embodiment of the present disclosure and the stay are coupled to the base.

As illustrated in FIG. 6, the positioner 45 of the second embodiment has a protruding portion 45*b*1 at the end portion of the positioner 45 in the longitudinal direction in addition to the protruding portion 45*b*2 at the center portion of the positioner 45 in the longitudinal direction. An insertion hole 45*a*1 is disposed in a protruding portion 45*b*1, and the insertion hole 45*a*2 is disposed in the protruding portion 45*b*2.

Figure 7:
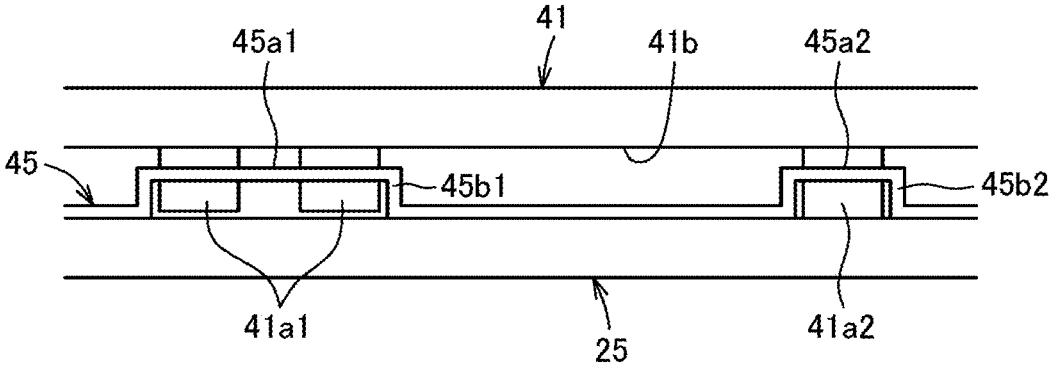
FIG. 7 is a front view illustrating a configuration around the positioner of the second embodiment.

As illustrated in FIG. 7, gaps exist between the protruding portions 45*b*1 and 45*b*2 and a lower surface 41*b* of the base 41 when the projections 41*a*1 and 41*a*2 are inserted into the insertion holes 45*a*1 and 45*a*2. That is, the projections 41*a*1 and 41*a*2 of the base 41 is in contact with the positioner 45 whereas another part of the base 41 is not in contact with the positioner 45. The above-described configuration can reduce the contact area between the base 41 and the positioner 45 and the amount of heat flowing out from the base 41 to the positioner 45. Therefore, the above-described configuration can improve the efficiency of heating the fixing belt in the fixing device.

Since the insertion holes 45*a*1 and 45*a*2 are disposed in the protruding portions 45*b*1 and 45*b*2 to insert the projections 41*a*1 and 41*a*2, the projections 41*a*1 and 41*a*2 can be inserted into the insertion holes 45*a*1 and 45*a*2 to the bases of the projections 41*a*1 and 41*a*2. Since the bases of the projections 41*a*1 and 41*a*2 are positioned with higher dimensional accuracy than the tops of the projections 41*a*1 and 41*a*2, the above configuration can improve the positioning accuracy of the base 41 with respect to the positioner 45 and the stay 25. The projection 41*a*2 inserted into the insertion hole 45*a*2 disposed the protruding portion 45*b*2 as illustrated in FIG. 6 provides the same advantage.

The projection 41*a*2 comes into contact with the stay 25 to position the base 41 in the vertical direction in FIG. 7. The projection 41*a*1 does not contact the stay 25 when the pressure roller is not pressed against the fixing belt, that is, in a pressure released state. Arranging the insertion hole 45*a*1 in the protruding portion 45*b*1 that protrudes from the positioner 45 and separates from the stay 25 as described above allows the projection 41*a*1 to be stably inserted into the insertion hole 45*a*1 without contacting the projection 41*a*1 with the stay 25. The above-described configuration can reduce the contact area between the base 41 and the positioner 45 and the stay 25, which can reduce the amount of heat flowing out from the base 41.

Figure 8:
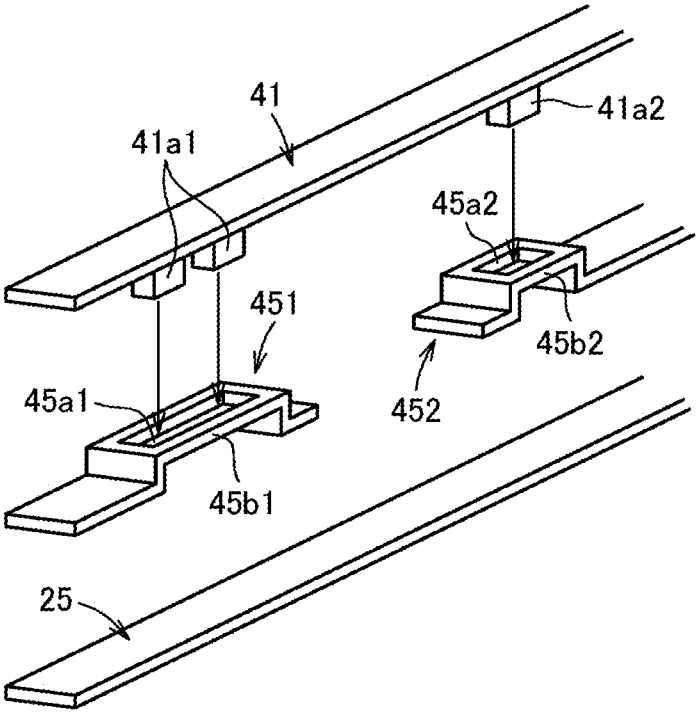
FIG. 8 is a perspective view illustrating how a positioner of a third embodiment of the present disclosure and the stay are coupled to the base.

Alternatively, the positioner may be divided into a plurality of parts. For example, as in a third embodiment illustrated in FIG. 8, the positioner may be divided into a first positioner 451 disposed on one end portion of the stay 25 in the longitudinal direction and having the insertion hole

45*a*1 and a second positioner 452 disposed from the center portion to the other end portion of the stay 25 in the longitudinal direction and having the other insertion hole 45*a*1 and the insertion hole 45*a*2. In other words, in the third embodiment, the positioner does not extend from the one end portion of the base 41 to the center portion of the base 41, and a gap exists between the first positioner 451 and the second positioner 452 in the longitudinal direction of the base 41. The first positioner 451 and the second positioner 452 are fixed to the stay 25 by appropriate means and, in the third embodiment, are fixed to the stay 25 by screws.

As in the third embodiment, separating the positioner into the first positioner 451 of the end portion of the positioner and the second positioner 452 of the center portion and the other end portion of the positioner and removing the portion therebetween can decrease the thermal capacity of the positioner. The above-described configuration can reduce the amount of heat transmitted from the nip formation pad 24 to the positioner and improve the efficiency of heating the fixing belt in the fixing device.

When the positioner is divided into a plurality of parts as described above, it is preferable that two or more projections of the base 41 are inserted into the insertion hole in each of the positioners 451 and 452. Positioning at two locations can prevent the base 41 from tilting in the short-side direction with respect to the first positioner 451, the second positioner 452, and the stay 25, and accurately position the nip formation pad with respect to the first positioner 451, the second positioner 452, and the stay 25. In the third embodiment, inserting a plurality of projections of the base 41 into each insertion hole disposed in each of the first positioner 451 and the second positioner 452 accurately positions the nip formation pad 24 with respect to the first positioner 451, the second positioner 452, and the stay 25.

Figure 9:
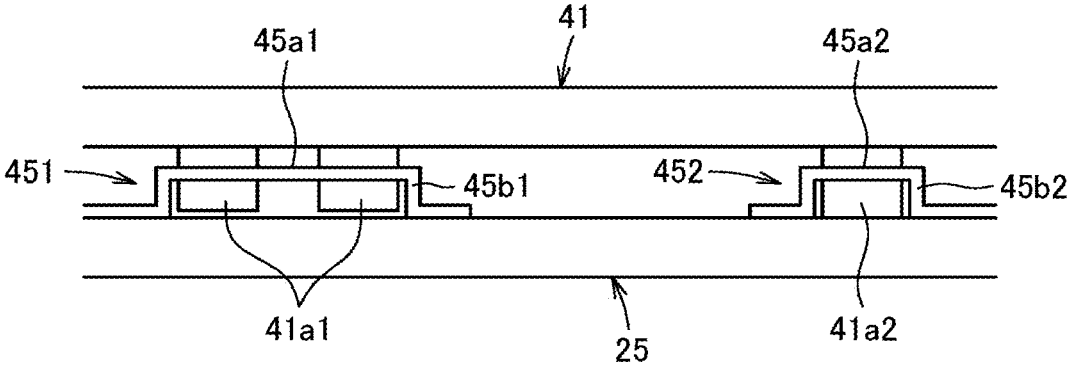
FIG. 9 is a front view illustrating a configuration around the positioner of the third embodiment.

In addition, as illustrated in FIG. 9, dividing the positioner 45 into a plurality of parts and providing a longitudinal gap between the first positioner 451 and the second positioner 452 keeps the positioner 45 away from the stay 25 at the gap and can decrease a contact area between the stay 25 and the first positioner 451 and the second positioner 452 when the projections 41*a*1 and 41*a*2 are inserted into the insertion holes 45*a*1 and 45*a*2. Therefore, the above-described configuration can decrease the amount of heat transfer from the first positioner 451 and the second positioner 452 to the stay 25 and improve the efficiency of heating the fixing belt in the fixing device.

The first positioner 451 and the second positioner 452 may be configured as flat plates. For example, like the insertion hole 45*a*1 illustrated in FIG. 5, the insertion holes 45*a*1 and 45*a*2 may be provided in the flat plates without arranging the protruding portions 45*b*1 and 45*b*2.

Figure 14:
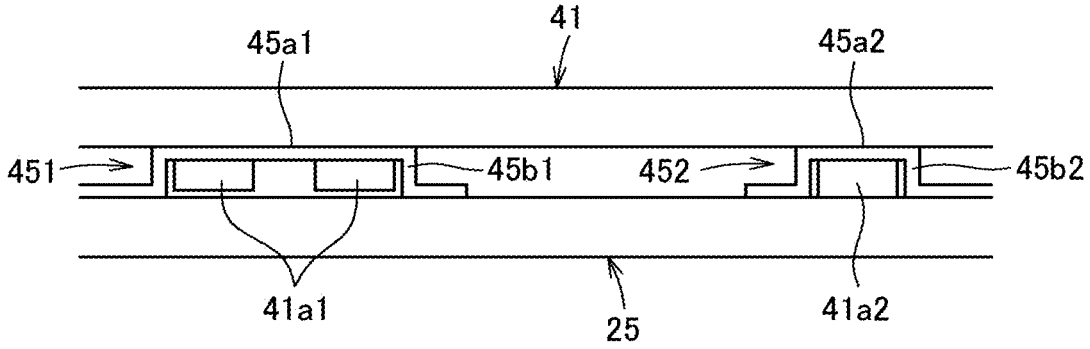
FIG. 14 is a front view illustrating a variation in relative positions of the positioner and the base that are different from those of the fourth embodiment.

Alternatively, as illustrated in FIG. 14, the projections 41*a*1 and 41*a*2 may be inserted into the insertion holes 45*a*1 and 45*a*2 to the bases of the projections 41*a*1 and 41*a*2. Since the bases of the projections 41*a*1 and 41*a*2 are positioned with higher dimensional accuracy than the tops of the projections 41*a*1 and 41*a*2, the above configuration can improve the positioning accuracy of the base 41 with respect to the positioner 45 and the stay 25.

Considering heat transfer in the longitudinal direction, it is preferable that the difference in the thermal capacities between the first positioner 451 and the second positioner 452 in the longitudinal direction is as small as possible. That is, reducing the difference in thermal capacity between the first positioner 451 and the second positioner 452 is preferable. For example, the second positioner 452 that is longer than the first positioner 451 is made thinner than the first positioner 451. Such a configuration can reduce temperature unevenness in the longitudinal direction of the fixing belt.

Figure 10:
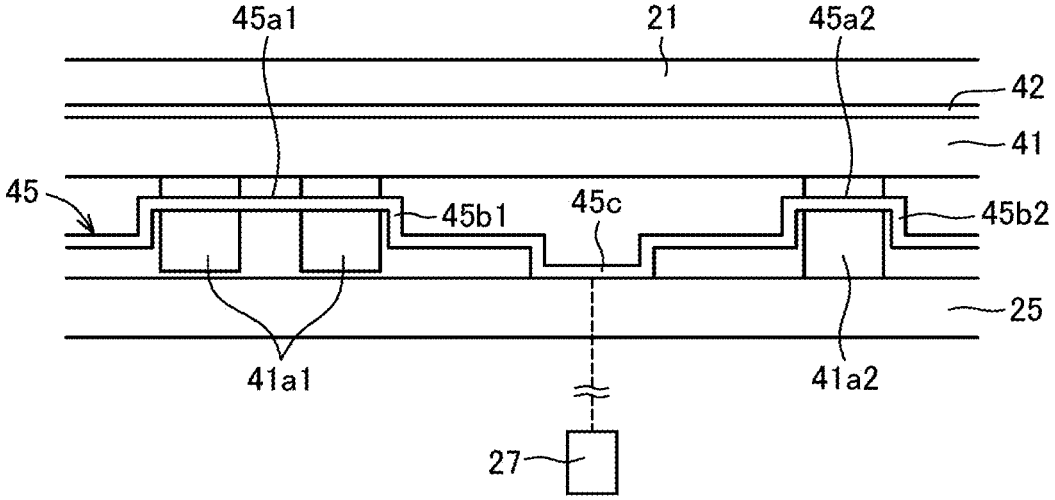
FIG. 10 is a front view illustrating a configuration around a positioner according to a fourth embodiment of the present disclosure.

The positioner of the present disclosure may be a single member like the positioner 45 as illustrated in FIG. 5 and the like and made not to contact the stay 25 other than a portion to fix the positioner on the stay 25. For example, in a fourth embodiment illustrated in FIG. 10, the positioner 45 has a fixing portion 45*c* protruding toward the stay 25. The fixing portion 45*c* is disposed between the protruding portion 45*b*1 and the protruding portion 45*b*2 in the longitudinal direction of the positioner 45. The fixing portion 45*c* may be fixed to the stay 25 by an appropriate method. In the fourth embodiment, the fixing portion is fixed by a screw. FIG. 10 illustrates the fixing portion 45*c* disposed between the protruding portions 45*b*1 and 45*b*2, but there may be a plurality of fixing portions in the longitudinal direction.

Distancing the positioner 45 from the stay 25 at a portion other than the fixing portion 45*c* of the positioner 45 can decrease the amount of heat transfer from the positioner 45 to the stay 25 and improve the efficiency of heating the fixing belt in the fixing device.

The temperature sensor 27 is disposed at a position corresponding to the fixing portion 45*c* in the longitudinal direction of the base 41. At the position corresponding to the fixing portion 45*c*, heat is transmitted from the positioner 45 to the stay 25, and the temperature of the fixing belt 21 tends to be low. Therefore, setting the temperature sensor 27 at the position corresponding to the fixing portion 45*c* as a reference position for temperature control of the fixing belt 21 can stably raise the temperature of the fixing belt 21 to the target fixing temperature over the longitudinal direction. As a result, the fixing failure of the image on the sheet can be prevented. Note that the reflector 26 and the like are provided between the temperature sensor 27 and the stay 25 (see FIG. 2), but their illustration is eliminated in FIG. 10.

Figure 11:
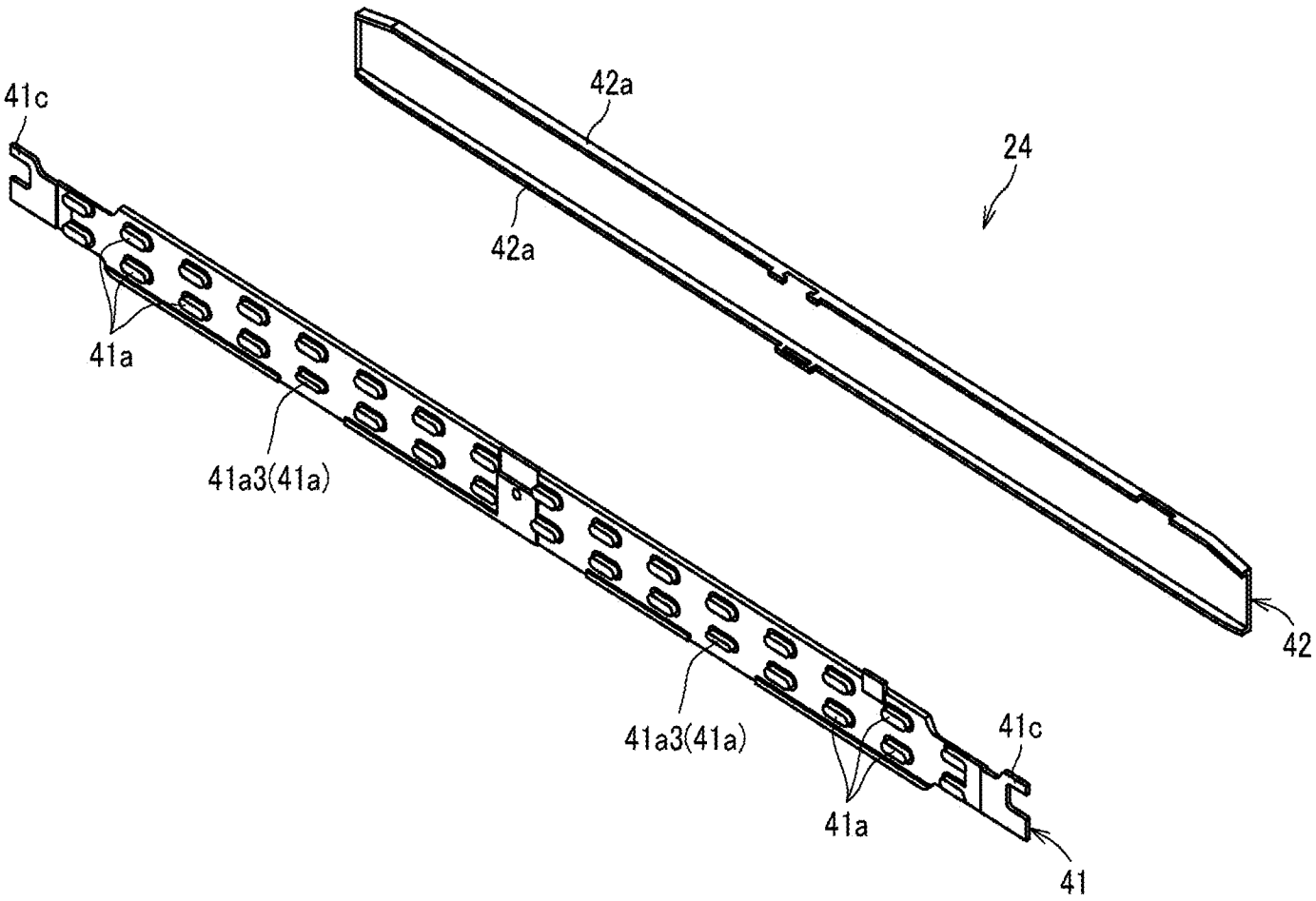
FIG. 11 is a perspective exploded view illustrating a nip formation pad of a fifth embodiment.
Figure 12:
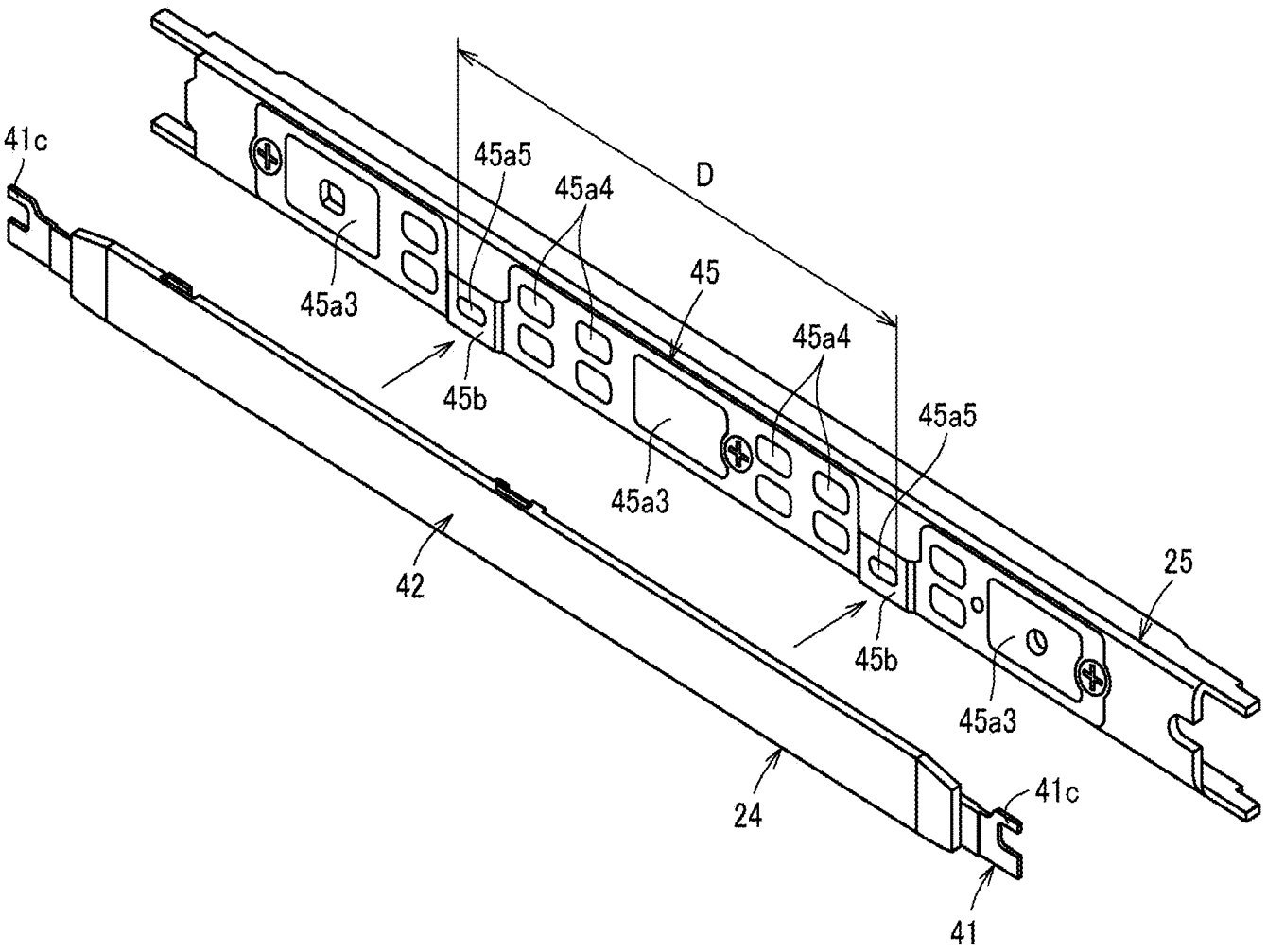
FIG. 12 is a perspective view illustrating how a positioner of the fifth embodiment of the present disclosure and the stay are coupled to the nip formation pad in FIG. 11.

In the above embodiments, the base 41 has one projection in the sort-side direction of the base 41. However, the base 41 may have a plurality of projections, and the positioner 45 may have a plurality of insertion holes. With reference to FIGS. 11 and 12, a fifth embodiment of the present disclosure as an example of the above-described configuration is described below.

As illustrated in FIG. 11, two rows of the projections 41*a* are arranged in the short-side direction of the base 41, and each row in the short-side direction includes a plurality of projections 41*a* arranged in the longitudinal direction.

As illustrated in FIG. 12, the positioner 45 has a plurality of insertion holes in the longitudinal direction of the positioner 45. Specifically, each of three insertion holes 45*a*3, which are slots, is disposed at each of one end portion, the center portion, and the other end portion of the positioner 45 in the longitudinal direction. Some of the plurality of projections 41*a* arranged in the longitudinal direction and aligned in two rows in the short-side direction are inserted into the insertion holes 45*a*3. The positioner 45 has a plurality of insertion holes 45*a*4 arranged in the longitudinal direction and aligned in two rows in the short-side direction. One of the projections 41*a* is inserted into each insertion hole 45*a*4. Additionally, the positioner 45 has protruding portions 45*b* each having an insertion hole 45*a*5. The protruding portion 45*b* having the insertion hole 45*a*5 is disposed at one of two positions of the positioner 45 in the longitudinal direction.

Figure 15:
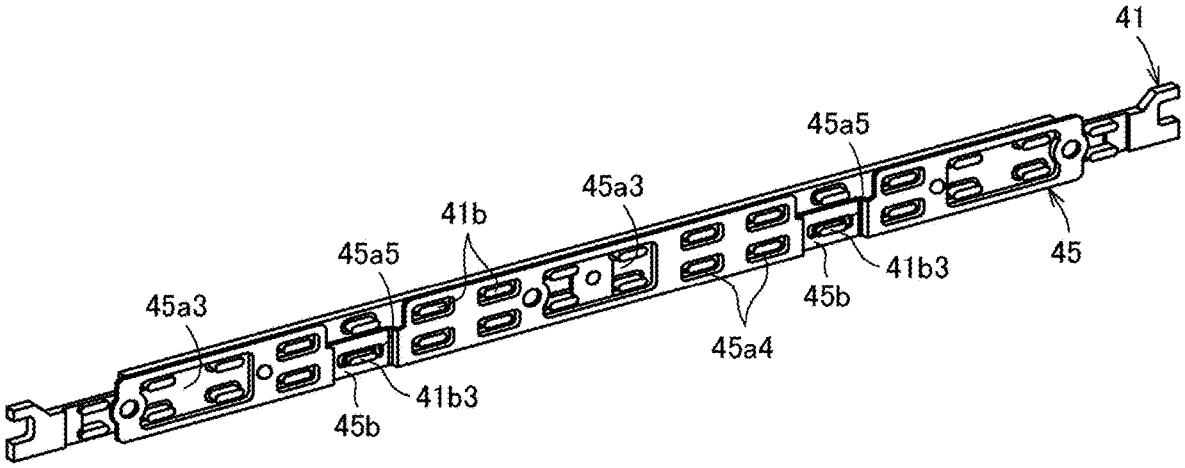
FIG. 15 is a perspective view illustrating the base and the positioner according to the fifth embodiment of the present disclosure as viewed from the back side of the positioner.

FIG. 15 is a perspective view illustrating the base 41 and the positioner 45 viewed from the back side of the positioner 45.

As illustrated in FIG. 15, each of the projections 41*a* of the base 41 is inserted into each of the insertion holes 45*a*3 to 45*a*5. Specifically, a total of four projections 41*a*, which are aligned in two rows in the longitudinal direction and in two rows in the short-side direction, are inserted into the long insertion hole 45*a*3. one of the projections 41*a* is inserted into one of the insertion holes 45*a*4. One of the projections 41*a*3 is inserted into one of the insertion holes 45*a*5. In particular, inserting each of the projections 41*a*3 into each of the insertion holes 45*a*5 in each of the protruding portions 45*b* positions the nip formation pad 24 with respect to the positioner 45 and the stay 25 in their short-side directions (a sheet conveyance direction and the opposite direction of the sheet conveyance direction) and their longitudinal directions.

In addition, contacting the projections 41*a* with the stay 25 can position the nip formation pad 24 with respect to the stay 25 in the thickness direction of the stay 25. For example, in the fifth embodiment, contacting the projections 41*a*3 with the stay 25 positions the nip formation pad 24 with respect to the stay 25 in the thickness direction. Also, in the fifth embodiment, since the insertion holes 45*a*5 are disposed in the protruding portions 45*b*, the projections 41*a*3 can be inserted into the insertion holes 45*a*5 to the bases of the projections 41*a*5.

As described above, in the fifth embodiment, inserting each of the projections 41*a* into each of the insertion holes 45*a*, in particular, inserting each of the projections 41*a*3 into each of the insertion holes 45*a*5, can position the nip formation pad 24 in the fixing device.

As illustrated in FIGS. 11 and 12, the fixing device according to the fifth embodiment includes the positioner 45 as a separate member to position the nip formation pad 24 with respect to the stay 25. The positioner 45 has two insertion holes 45*a*5 as positioning portions, and the nip formation pad 24 has two projections 41*a*3 as positioning portions. The insertion holes 45*a*5 and the projections 41*a*3 are provided at two locations in the longitudinal direction closer to the center portion of the positioner 45 than the both ends of the positioner 45. Specifically, as illustrated in FIG. 12, the insertion holes 45*a*5 are disposed at an interval of a distance Din the longitudinal direction including their own length and within a range of the pressure roller 22 in the longitudinal direction. The distance D is set to be equal to or longer than half the axial length of the pressure roller 22. Too large an interval between the insertion holes 45*a*5 (or the projections 41*a*3) may cause a deformation of the center portion of the nip formation pad 24 which is not supported. In contrast, too narrow an interval between the insertion holes 45*a*5 may cause unstable parallelism of the nip formation pad 24 because the stay 25 may not support the end portions of the nip formation pad 24. Considering the above factors, in the fifth embodiment, arranging the insertion holes 45*a*5 as described above and as a more preferable configuration causes the stay 25 to stably support the nip formation pad 24 over the longitudinal direction and can prevent the deformation and inclination of the nip formation pad 24 as described above.

Figure 16:
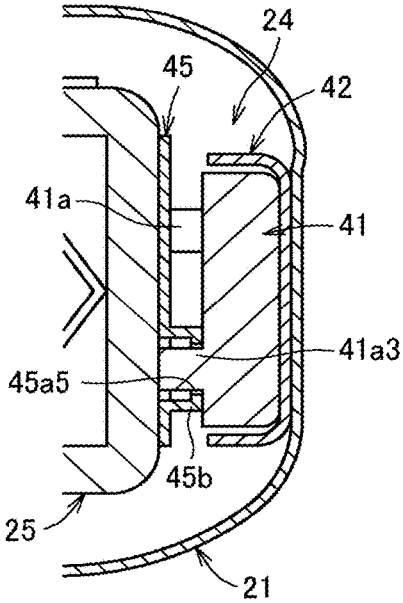
FIG. 16 is a side sectional view illustrating the fixing device according to the fifth embodiment of the present disclosure.

In the present embodiment, as illustrated in FIG. 16, arranging the projections 41*a*3 and the insertion holes 45*a*5 on the upstream side of the base 41 and the stay 25 in the sheet conveyance direction prevents the nip formation pad 24 from inclining in the rotation direction B2 (see FIG. 2) of the fixing belt 21 even when rotations of the fixing belt 21 in the rotation direction B2 applies a force in the rotation direction to the nip formation pad 24 and can minimize the contact area between the base 41 and the stay 25 to reduce heat flowing into the stay 25 as much as possible.

Arranging the projections 41*a* of the base 41 in a plurality of rows can distribute pressure applied to the projections 41*a* when the pressure roller presses against the fixing belt, for greater mechanical strength. On the other hand, as described above, the number of the projections 41*a* is preferably not too large in order to minimize the amount of heat transfer from the nip formation pad 24 to the stay 25 and the positioner 45. Considering these factors, the projections 41*a* of the base 41 are preferably arranged in three rows or fewer in the short-side direction of the base 41.

The present disclosure is not limited to the embodiments described above, and various modifications and improvements are possible without departing from the gist of the present disclosure.

Figure 13:
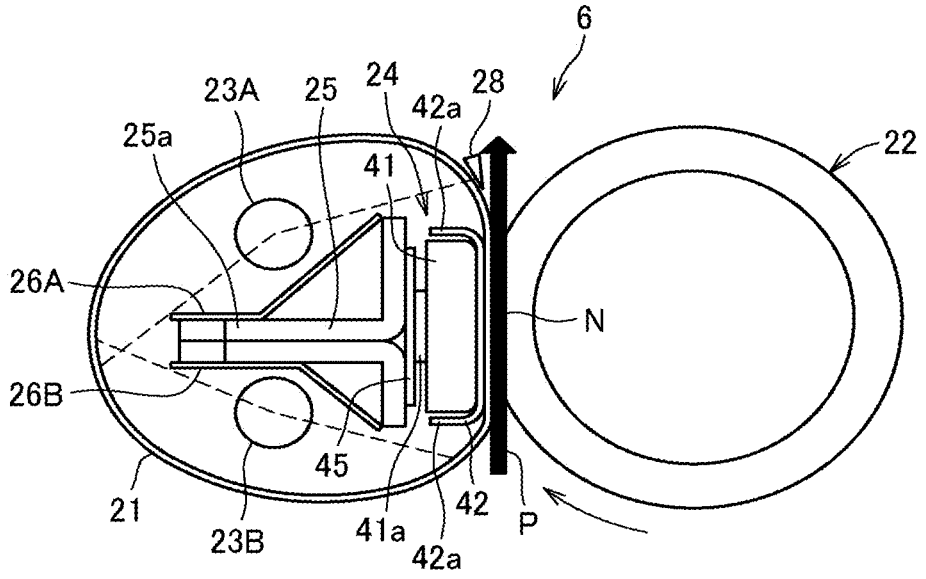
FIG. 13 is a side view illustrating a fixing device having a configuration different from the configuration illustrated in FIG. 2.

For example, the nip formation pad according to the embodiment described above is also applicable to a fixing device 6 including a plurality of heaters as illustrated in FIG. 13. Referring now to FIG. 13, a description is given of the fixing device 6 according to another embodiment of the present disclosure, focusing on the differences between the fixing device illustrated in FIG. 2 and the fixing device illustrated in FIG. 13. Redundant descriptions of identical configurations are omitted unless otherwise required.

Similar to the fixing device in the above embodiments, the fixing device 6 includes the fixing belt 21 as the belt, the pressure roller 22, and the nip formation pad 24 as illustrated in FIG. 13. In addition, the fixing device 6 of the present embodiment includes two heaters 23A and 23B. One of the heaters 23A and 23B includes a center heat generation area spanning a center of the one of the heaters 23A and 23B in the longitudinal direction thereof to heat toner images on small sheets P passing through the fixing nip N. The other one of the heaters 23A and 23B includes a lateral end heat generation area spanning each end portion of the other one of the heaters 23A and 23B in the longitudinal direction thereof to heat toner images on large sheets P passing through the fixing nip N. In the present embodiment, the halogen heaters 23A and 23B are used. Alternatively, the heaters may be induction heaters, resistance heat generators, carbon heaters, or the like.

In the fixing device 6, the stay 25 has a T-shaped cross-section. Specifically, the stay 25 includes an arm portion 25*a* projecting from a base portion of the stay 25 away from the fixing nip N. The arm portion 25*a* is interposed between the heaters 23A and 23B, thus separating the heaters 23A and 23B from each other.

A power supply situated inside the image forming apparatus 1 supplies power to the heaters 23A and 23B so that the heaters 23A and 23B generate heat. A controller operatively connected to the heaters 23A and 23B and the temperature sensor controls the heaters 23A and 23B based on the temperature of the outer circumferential surface of the fixing belt 21, which is detected by the temperature sensor disposed opposite the outer circumferential surface of the fixing belt 21. Such heating control of the heaters 23A and 23B adjusts the temperature of the fixing belt 21 to a desired fixing temperature.

The reflectors 26A and 26B are interposed between the stay 25 and the heaters 23A and 23B, respectively, to reflect light radiated from the heaters 23A and 23B toward the fixing belt 21, thereby enhancing heating efficiency of the heaters 23A and 23B to heat the fixing belt 21. The reflectors 26A and 26B prevent light and heat radiated from the heaters 23A and 23B from heating the stay 25, reducing energy waste.

The above-described fixing device 6 may use the above-described configuration of the nip formation pad 24 and the positioner 45. As a result, the nip formation pad 24 can be accurately positioned on the stay 25, and the effects of the above-described embodiments can be obtained.

The image forming apparatus 1 according to the present embodiments of the present disclosure is applicable not only to a color image forming apparatus illustrated in FIG. 1 but also to a monochrome image forming apparatus, a copier, a printer, a facsimile machine, or a multifunction peripheral including at least two functions of the copier, printer, and facsimile machine.

The sheets P as recording media may be thick paper, postcards, envelopes, plain paper, thin paper, coated paper, art paper, tracing paper, overhead projector (OHP) transparencies, plastic film, prepreg, copper foil, and the like.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

an endless belt;

an opposed rotator opposite the belt;

a nip formation pad disposed inside a loop of the belt and configured to contact the opposed rotator via the belt to form a fixing nip between the opposed rotator and the nip formation pad, nip formation pad having a first plurality of projections in a longitudinal direction of the nip formation pad;

a heater configured to heal the belt, disposed inside the loop of the belt;

a stay disposed inside the loop of the belt to support the nip formation pad; and a positioner configured to position the nip formation pad in the fixing device, disposed between the nip formation pad and the stay, the positioner having a plurality of insertion holes arranged in a longitudinal direction of the positioner and configured to accept the first plurality of projections and restrict movement of the nip formation pad with respect to the positioner in a rotation direction of the belt and a direction opposite the rotation direction of the belt, the plurality of insertion holes including an insertion hole disposed at a position corresponding to an end portion of the nip formation pad and configured to accept two or more projections of the first plurality of projections arranged in the longitudinal direction of the nip formation pad.

2. The fixing device according to claim 1, wherein the positioner is a rectangular plate and includes a protruding portion disposed at a position corresponding to a center portion of the nip formation pad and partially folded to protrude toward the nip formation pad and form a gap between the stay and the protruding portion, and wherein the protruding portion has an insertion hole of the plurality of insertion holes.

3. The fixing device according to claim 2, wherein the protruding portion, at the position corresponding to the center portion of the nip formation pad, is configured to form a gap between the protruding portion and a surface of the nip formation pad from which the first plurality of projections projects.

4. The fixing device according to claim 1, wherein the positioner includes a plurality of parts separated and arranged in the longitudinal direction of the positioner.

5. The fixing device according to claim 1, further comprising a second plurality of projections arranged in a direction perpendicular to the longitudinal direction of the nip formation pad.

6. The fixing device according to claim 1, further comprising a temperature sensor configured to detect a temperature of the belt, wherein the positioner is fixed to the stay, and the temperature sensor is disposed corresponding to a position at which the positioner is fixed to the stay.

7. An image forming apparatus comprising the fixing device according to claim 1.

8. A fixing device, comprising:

an endless belt;

an opposed rotator opposite the belt;

a nip formation pad disposed inside a loop of the belt and configured to contact the opposed rotator via the belt to form a fixing nip between the opposed rotator and the nip formation pad, the nip formation pad having a plurality of projections arranged in multiple rows extending in a longitudinal direction of the nip formation pad;

a heater configured to heat the belt, disposed inside the loop of the belt;

a stay disposed inside the loop of the belt to support the nip formation pad; and a positioner configured to position the nip formation pad in the fixing device, disposed between the nip formation pad and the stay, the positioner having a plurality of insertion holes arranged in a longitudinal direction of the positioner and configured to accept the plurality of projections and restrict movement of the nip formation pad with respect to the positioner in a rotation direction of the belt and a direction opposite the rotation direction of the belt, the plurality of insertion holes including an insertion hole disposed at a position corresponding to an end portion of the nip formation pad and configured to accept two or more projections of the plurality of projections arranged in the longitudinal direction of the nip formation pad.

* * * * *